United States Patent [19]

Otzen

[11] 4,261,378

[45] Apr. 14, 1981

[54] ACCESSORY FOR PARTS WASHER

[75] Inventor: Karl G. Otzen, Barrington, Ill.

[73] Assignee: Safety-Kleen Corporation, Elgin, Ill.

[21] Appl. No.: 59,069

[22] Filed: Jul. 19, 1979

[51] Int. Cl.[3] ..... B08B 3/02

[52] U.S. Cl. ..... 134/56 R; 134/115 R; 134/186; 4/286; 4/287; 4/292; 137/577

[58] Field of Search ..... 134/56 R, 115 R, 136, 134/143, 186, 197; 4/286, 287, 290, 292, 295; 137/577

[56] References Cited

U.S. PATENT DOCUMENTS

| | | | |
|---|---|---|---|
| 2,632,473 | 3/1953 | Hollerith | 134/186 X |
| 3,522,814 | 8/1970 | Olson | 134/11 |
| 4,052,227 | 10/1977 | Delo et al. | 134/56 R |
| 4,086,929 | 5/1978 | Focht | 134/143 X |

FOREIGN PATENT DOCUMENTS

| | | | |
|---|---|---|---|
| 151278 | 2/1932 | Switzerland | 4/295 |

*Primary Examiner*—Robert L. Bleutge
*Attorney, Agent, or Firm*—James T. FitzGibbon

[57] ABSTRACT

An accessory adapted to be attached to the drain opening of a sink of a parts washer including an upright tubular housing, having a plurality of drain ports at a lower end thereof. A stopper is selectively movable in said housing from a first position above the drain ports to a second position below the ports by the application of force to a shaft operatively coupled thereto. In the first position of the stopper, drainage of fluid from the sink occurs through the drainage port and the drain outlet. In the second position, fluid is blocked from egress through the drain port and the drain opening of the sink and collects in the sink to a predetermined level whereby a series of overflow drain ports drain excess fluid to maintain a constant level of solvent. The shaft is coupled to a spring urging the stopper to the first position when a force is removed from the shaft.

26 Claims, 6 Drawing Figures

36
35
32
4
24
53
30
31
4
70
23
71
41
22
42
21
20
72
40
73
43
43a
5
5
74
50a
52
50
51
60
60
81
80
3
25
26
75
26a
9
33
34
82
34a 36
35
70
32
71
41
72
40
73
50
26
80
33
74

ACCESSORY FOR PARTS WASHER

BACKGROUND OF THE INVENTION

This invention relates in general to parts washers and, in particular, to an accessory for a parts washer for cleaning mechanical parts and the like.

More specifically, without restriction to the particular use which is shown and described, this invention relates to an accessory for a parts washer, by which a parts washer of suitable design can safely and effectively subject parts to be washed to a circulating flow of cleaning fluid or, alternatively, to a soaking action by the selection retention of a predetermined level of circulating cleaning fluid in a sink. The accessory of the invention permits known parts washers to operate as intended without interference in a normal mode of operation to clean, while providing a soaking capability through which parts and the like may be cleaned under controlled safe conditions.

In numerous industries, such as in performing mechanical services in automobile parts repair and replacement and the like, there exists the crucial need to clean component mechanical parts prior to inspection, repair, or replacement thereof. Generally, such parts have been exposed to various contaminants such as dirt, grease and the like, which must be removed for effective repair or service. In the prior art, a variety of washing techniques have been employed to provide the requisite cleaning of the components as needed.

One highly effective parts washer, universally used in the industry, is described in U.S. Pat. No. 3,522,814 to Olson entitled Washer For Parts and the Like, to which reference herein is specifically made. The device described in the foregoing patent to Olson has been extremely successful in the industry by providing a parts washer having economical and hazard-free operation to subject parts to be cleaned to a circulating flow of solvent and the like. In operation of the device described in the Olson patent, a pump circulates a solvent from a drum into a sink containing parts for cleaning. A flow of solvent is directed against the parts and drains from the sink through a filtering medium for return to the drum. In the event of a fire, the washer described in U.S. Pat. No. 3,522,814 is capable of automatically closing a cover over the sink to minimize its effect.

Although the washer of U.S. Pat. No. 3,522,814 provides highly improved operative characteristics during cleaning, it has been found that it becomes advantageous to subject parts for a period of time to a soaking bath in a solvent or other fluid under certain encountered conditions such as, for example, where an extraordinary amount of foreign material is affixed to the elements to be washed. In known techniques, such soaking is accomplished generally by positioning the parts in a volume of fluid in an opened container from which undesired solvent fumes may be evaporated to the surroundings with a resulting costly depletion of fluid and the danger of uncontrolled fire or spilling being present. The prior art devices are lacking in the capability of maintaining a predetermined volume of solvent for soaking with the introduction of fresh solvent for better washing. The prevention of such uncontrolled soaking in an open vessel has become more advantageous in the light of numerous government regulations governing the use of substances in the form of solvents such as required by O.S.H.A. and the like. Thus, it is highly advantageous that an accessory be provided which allows effective washing of parts with drainage such as disclosed in U.S. Pat. No. 3,522,814, with the alternative mode of operation as a highly effective and non-hazardous soaking device.

The accessory herein disclosed overcomes the foregoing problems by permitting a conventional washer to operate in its normal circulating mode without a substantial soaking action, with the added improvement of selectively retaining a quantity of solvent in a sink for a soaking application. The soaking operation provided by the accessory of the invention is accomplished by a device which prevents the escape of fumes to the surroundings and the costly evaporation of the cleaning solvent, and which at the same time minimizes the danger of fire and other accidents. In addition, the accessory of the present invention provides improved soaking by maintaining a predetermined level of fluid over the parts to be cleaned with constant circulation of the solvent. The device of the invention accomplishes such improved results with an economical device which requires little or no modification of existing washing equipment.

It is, therefore, an object of the present invention to improve the operation of washers for parts and the like;

A further object of the invention is to provide an accessory for parts and the like permitting the washer to operate in two modes of cleaning;

Another object of the invention is to provide an accessory for a washer permitting the soaking of parts therein in an economical, safe, and highly effective manner;

A still further object of the invention is to provide an accessory for a washer which can be adapted to any equipment with minimal modification;

Still another object of the invention is to soak parts and the like in a container by circulating fluid therethrough while maintaining a predetermined level of fluid;

These and other objects are attained in accordance with the present invention wherein there is provided an accessory for a parts washer capable of being positioned in the parts receiving sink of a known device by which, in a first operative mode, cleaning solvent and the like may selectively be drained from the sink subjecting the components to washing without a substantial accumulation of fluid therein. In a second operative position, the accessory herein disclosed permits the accumulation of a predetermined quantity of cleaning fluid within the parts containing sink for exposing the parts to be cleaned to a soaking action. The retention by the invention herein of fluid in the sink of a washer for such soaking may be automatically terminated by release of a downward force on an actuator means of the accessory being applied either by a protective cover, manual depression, and the like. To this end, the improved accessory of the application may effect a soaking action of parts to be cleaned in a washer in cooperation with a cover being placed over the solvent to be retained or that the accumulation of solvent is maintained in the presence of the operator. In a soaking mode, the accessory of the invention maintains a predetermined amount of fluid within the container to prevent overflowing and minimizes the potential danger of fire and vapor being transmitted to the surroundings.

DESCRIPTION OF THE DRAWINGS

Further objects of the invention, together with additional features contributing thereto, and advantages accruing therefrom will be apparent in the following description of a preferred embodiment of the invention which is shown in the accompanying drawings wherein like reference numerals indicate corresponding parts throughout, wherein.

DESCRIPTION OF A PREFERRED EMBODIMENT

Figure 1:
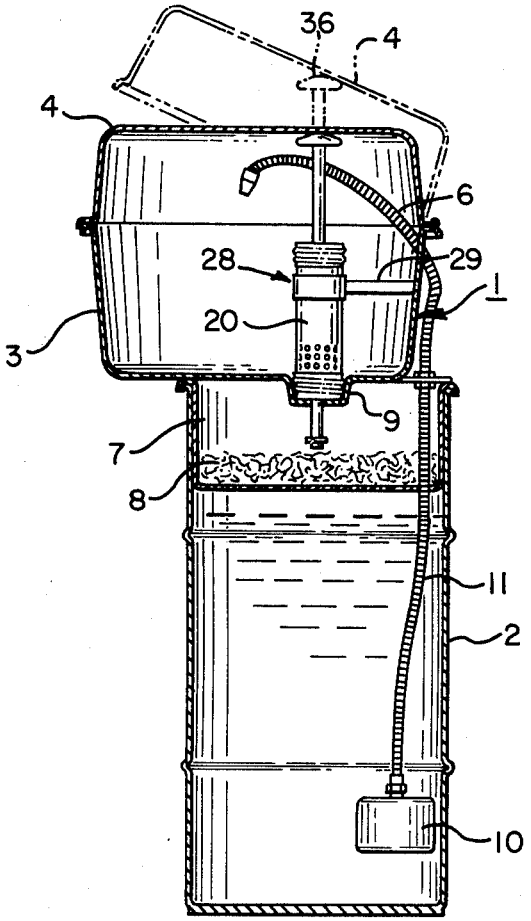
FIG. 1 is a side schematic illustration, with parts in section, showing the accessory of the invention in operative position on a parts washer.

Although not intended to be so limited, the accessory of the invention is described with reference to the parts washer illustrated in FIG. 1. However, it is within the scope of the invention to use the accessory of the invention in conjunction with other parts washers than as illustrated or alternatively, to control the level or drainage of fluid in sinks, containers, vessels, and the like, used in other numerous applications and environments. The parts washer 1 in FIG. 1 is similar in structure and operation to the device described and claimed in U.S. Pat. No. 3,522,814, reference to which is made for greater details of the structure and operation of the overall washer. Essentially, parts washer 1 is adapted to be mounted on a container 2, such as a cylindrical drum, which contains cleaning solvent and the like to be circulated into contact with the parts to be washed (not shown). The parts washer 1 comprises a number of components including a sink 3, a pivotally mounted cover 4, and a fluid conduit 6. Cover 4 is shown in a closed position in FIG. 1, and in phantom, in an open position.

A body 7, having filter elements 8, is disposed beneath the sink to receive solvent drained from sink 3 through an outlet drain opening 9. A motor and pump unit 10 is coupled to the upper washer body by any suitable attachment means (not shown) such as, for example, by an elongated shaft, and includes a conduit 11 extending upwardly into integral fluid communication with conduit 6. A switch (not shown) effects operation of the motor and pump unit 10 to direct a flow solvent contained in drum 2 upwardly to be directed from conduit 6 into contact with the parts to be washed in sink 3.

Figure 2:
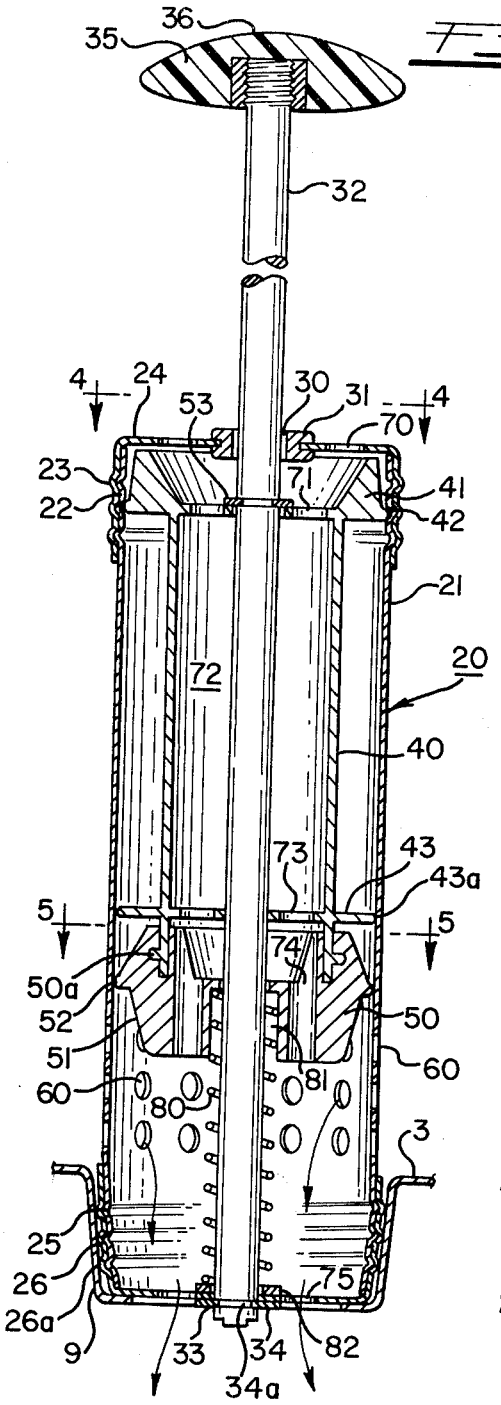
FIG. 2 is a sectional illustration of the accessory of FIG. 1 shown in an open position permitting drainage of the solvent without accumulation in the vessel.
Figure 3:
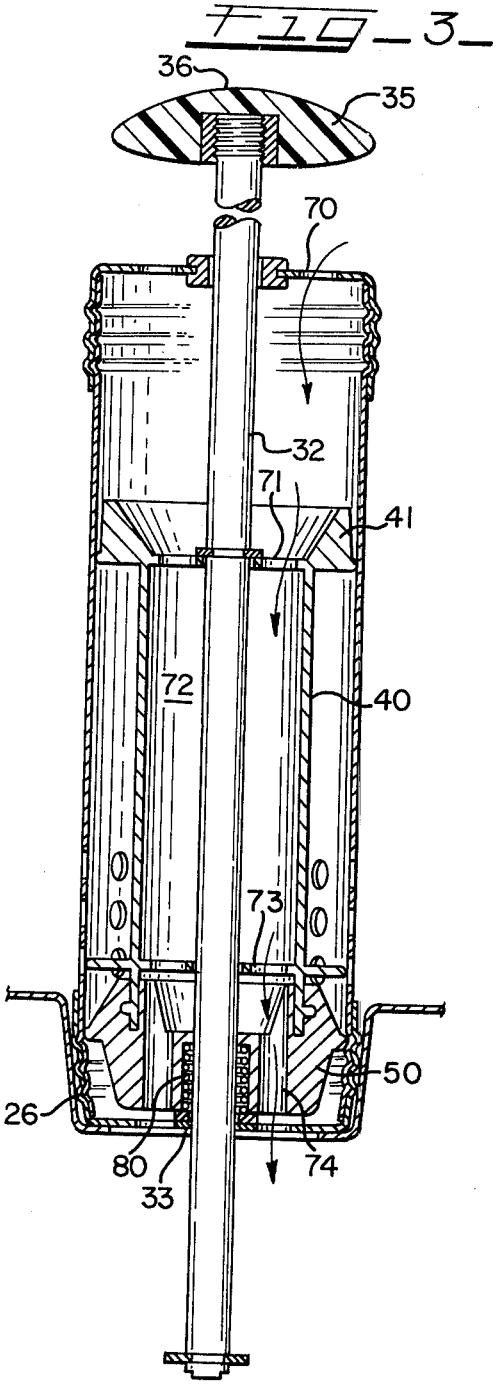
FIG. 3 is a side sectional illustration of the accessory of FIG. 1 shown in a second operative position permitting accumulation of solvent or fluid at a predetermined level within the sink of the washer.

As shown in FIG. 1, parts washer 1 is fitted with the accessory 20 of the invention adapted to be removably coupled to the drain 9 of the sink 3 in a manner to be described in detail later. As best illustrated in FIGS. 2 and 3, accessory 20 includes a tubular body 21 in the form of a hollow cylinder fabricated from metal and the like which, in operative position on the washer, is adapted to be oriented with its longitudinal axis extending substantially in a vertical direction. Tube 21 is provided with external threads 22 to engage corresponding internal threads 23 formed in a cover 24 enclosing the upper end of the tube. The bottom end of tubular member 21 is further provided with external rolled threads 25 interconnecting with a tapered bottom member 26. The bottom member 26 includes an outer periphery having outer protrusions 26*a* to create a press fit when inserted in drain 9 to rigidly support tube 21 in a sealed relationship therewith. Stability of accessory 20 in sink 3 is further enhanced by a brace 28, which is retained to tube 21, and having leg 29 extending into contact with an interior wall of sink 3, as shown in FIG. 1.

Referring again to FIGS. 2 and 3, upper cover 24 is formed with a central opening 30 fitted with a bushing 31 through which an elongated shaft 32 extends vertically the entire length of the tube 21 extending through a hole 33 in the bottom member 26. The bottom end of the shaft 32 is provided with a snap ring 34 positioned in a suitable groove 34*a* formed in the shaft 32 to act as an abutment and prevent movement of the end of the shaft through hole 33. A cover knob or actuator 35 is mounted by a thread connection to the upper end of shaft 32 situated above tube 21 and includes a curved upper configuration 36 to maintain continuous positive contact with cover 4 during its movement from an open position shown in phantom to a closed position in FIG. 1. Alternatively, the knob 35 may be operated manually or by other suitable techniques if desired.

An interior drain cavity member and stopper guide 40 in the form of a hollow cylinder, having a length less than the height of the tube 21, is mounted for reciprocal movement therein in coupling relationship to shaft 32. The upper portion 41 of the interior cavity member 40 possesses an outer enlarged radial periphery terminating with a circumferential lip 42 adapted to slide in sealed relationship to the inner periphery of the tube 21 as best shown in FIG. 3. The outer periphery of the central portion of the cavity member 40 is spaced from the inner wall of the tube 21 and possesses adjacent its lower end, an integral disc-like portion 43 having an edge 43*a* also in bearing sealed contact with the inner wall of the tube 21.

The bottom end of the interior cavity member 40 is coupled to a stopper 50 by means of a rib and groove arrangement 50*a* whereby the stopper is movable from the upper position shown in FIG. 2 to the lower position in FIG. 3 upon a force being applied to the knob 35 by means of the cover 4 (FIG. 1), manually, or by other means. The stopper 50 includes a pair of outwardly tapered surfaces 51 terminating with an outer lip 52 which slides in sealing contact with the inner wall of tube 21.

The upper portion 41 and disc 43 of cavity member 40, and stopper 50 are provided with aligned central openings through which shaft 32 is disposed. A snap ring 53 is situated in a groove formed on shaft 32 and possesses a bottom surface contacting the upper portion 41 to move the member 40 in unison with shaft 32, when downwardly directed force is applied to knob 35 as best illustrated in FIGS. 2 and 3.

Tube 21 is formed with a plurality of lower drainage ports 60, which, in the open position of the stopper 50 in FIG. 2, permits fluid in sink 3 to flow into the tube downwardly through the drain 9 into the filtering body 7. During operation of the washer 1 with stopper 50 in an open position, fluid introduced into sink 3 is constantly drained from the washer without any substantial retention in sink 3. Upon compression of the shaft 32 in the manner previously described and shown in FIG. 3, the guide member 40 and stopper 50 move downwardly into a position adjacent the bottom member 26 of tube 21 and block drainage of fluid from sink 3 through ports 60.

Figure 4:
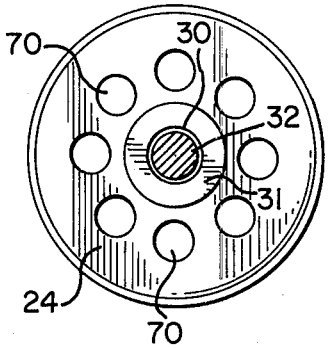
FIG. 4 is a top sectional illustration of the accessory of the invention, taken along line 4—4 of FIG. 2.
Figure 5:
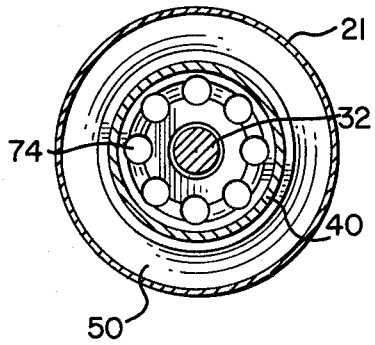
FIG. 5 is a top sectional illustration of the accessory of the invention, taken along line 5—5 of FIG. 2.
Figure 6:
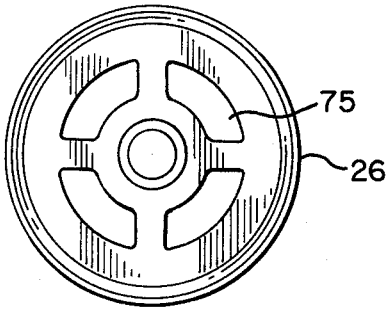
FIG. 6 is a top schematic illustration, taken along the line 6—6 of FIG. 2.

In the depressed position of the shaft 32 and stopper 50 as shown in FIG. 3 creating such blockage, an overflow passage is created through the accessory of the invention through which cleaning solvent and the like may drain upon a predetermined level of fluid being collected in sink 3. Overflow fluid is introduced to the overflow passage through ports 70 formed in the upper cover 24 situated in an array as best shown in FIG. 4. When the solvent in the sink has reached the overflow level, excess fluid enters tube 21 through ports 70 and flows downward through a plurality of apertures 71 formed in the upper portion 41 of internal guide 40 as shown by arrows in FIG. 3. An internal drain passage 72 is created by interior cavity member 40 from which egress is provided by ports 73 of disc 43, and conduits 74 extending through stopper 50 as seen in FIGS. 3 and 5. Tapered bottom 26 further includes a plurality of apertures 75 permitting drainage of the overflow through drainage opening 9 as shown in FIGS. 2 and 6. From the foregoing, it should be apparent that a predetermined level of solvent is maintained in sink 3 while motor and pump unit 10 is operating because excess fluid is constantly drained through the overflow drainage passage.

The shaft 32 and stopper 50 is biased in the upward position of FIG. 2 by means of a resilient return spring 80 disposed in surrounding relationship to shaft 32 between a cavity 81 formed in the bottom of stopper 50 and suitable flat washer 82 mounted on the shaft adjacent tapered bottom 26. The spring 80 is compressed upon depression of knob 35 as shown in FIG. 3, and urges the stopper and shaft upward when a force is removed. Thus, the shaft and stopper will automatically return to the upper position of FIG. 2 by lifting cover 4 of the sink 3 upwardly (as shown in phantom in FIG. 1) or by an operator manually releasing the knob. Upon the return to the upward position in FIG. 2, accumulated fluid in sink 3 will then drain as previously described.

In operation, the parts washer shown in FIG. 1 can be operated in a first mode with the cover 4 in an open position wherein a motor and pump unit 10 circulates the solvent or other fluid into washing contact with the parts to be cleaned. In this mode the solvent is substantially drained through the lower ports 60 and drain opening 9 for constant circulation without an accumulation of fluid in the sink. In the event the operator desires to soak the parts in sink 3, the shaft 32 of the accessory of the invention can be depressed through knob 35 by closing the cover 4 or, alternatively, by an operator manually moving shaft 32. As motor and pump unit 10 operates, a predetermined level of fluid in the sink is then established with excess fluid draining through upper ports 70 and ultimately through drain opening 9. It is advantageous to close cover 4 during soaking since it prevents uneconomical evaporation and escape of fumes and permits a soaking action with a high degree of safety. However, even in the case of manual manipulation of knob 35 by an operator, the accessory of the invention is responsive to potential problems since release of the handle will automatically return the shaft to the upward position of FIG. 2 and rapid drainage of fluid from the sink will occur.

From the foregoing, it should be apparent that the accessory of the invention comprises an effective and economical device which permits the parts washer shown in FIG. 1 to safely soak parts for any predetermined period. When cover 4 of the washer is closed, the potential dangerous conditions for personnel and the surroundings are alleviated, previously a persisting threat in the use of volatile cleaning fluid stagnantly retained in a conventional open sink. The accessory of the invention further permits the collected soaking fluid to be maintained at a constant level in sink 3 with fresh solvent being continuously introduced through operation of the pump 10 for improved cleaning.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An accessory for a parts washer having a container in which parts to be washed by a fluid are positioned comprising body means adapted to be attached to the outlet drain of a parts receiving container of a washer, fluid control means operatively mounted within said body means for movement upon application of a force thereto to control the flow of fluid introduced into the parts receiving container to the outlet drain, said fluid control means including a flow control element being movable between a first position permitting substantial drainage of fluid introduced into the container and a second position blocking drainage of a predetermined level of fluid, said fluid control means having a tubular body forming an overflow passage in fluid communication with the outlet drain, said housing means further including first port means in fluid communication with said overflow passage to drain fluid above said predetermined level in said second position of said control element, said fluid control means further including means arranged to apply a force between said body means and said fluid control means for automatically urging said fluid control means to said first position, said body means further including second port means creating fluid communication between the container and the outlet drain in said first position of the control element, said first position of said flow control element being situated at a position within said body means above said second port means and said second position being situated at a position beneath said second port means, and said control element including a peripheral surface having at least a portion in contact with said body means to aid in guiding said control element during movement between said first position and said second position.

2. The accessory according to claim 1 wherein said body means includes an end portion having a periphery adapted to be positioned in sealed relationship in the outlet drain.

3. The accessory according to claim 1 wherein said fluid control means includes an actuator means for displacing the flow control element from said first position to said second position.

4. The accessory according to claim 1 wherein said body means extends substantially vertically upward from the outlet drain.

5. The accessory according to claim 1 wherein said fluid control element comprises a stopper movable in the body means from a location above said second port means in said first position to a location beneath said second port means in said second position.

6. The accessory according to claim 5 wherein said fluid control means further includes an elongated shaft coupled to the plunger and being mounted for displacement relative to the body means to move the plunger from the first to the second position and the second to the first position.

7. The accessory according to claim 6 wherein said means automatically urging said flow control element to the first position is a resilient means operatively coupled to the elongated shaft.

8. The accessory according to claim 7 wherein said elongated shaft extends upwardly beyond the upper end of the body means.

9. The accessory according to claim 8 wherein said elongated shaft includes a force receiving end adapted to receive a force for displacing said flow control element to said second position.

10. An accessory for a parts washer comprising a housing means having a lower end adapted to be coupled to a drain opening of a sink of a parts washer in an upright vertical orientation, said housing means further including a bottom member having at least one aperture in fluid communication with the drain opening, said housing means further having a drainage port means positioned at a lower portion thereof and overflow port means positioned at an upper position thereof, a tubular member disposed within said housing means, a stopper mounted on said tubular member within said housing means for movement between a first position above said drainage port means to a second position beneath said drainage port means, said stopper having a periphery in continuous contact with said housing means, said tubular member having an internal overflow passage in fluid communication with said overflow ports and the drain opening, said housing means creating a drainage flow passage between said drainage ports and the drain opening, shaft means operatively coupled to said stopper and extending above said housing means for moving said stopper from said first position to said second position upon application of a force thereto, resilient means coupled to the shaft means for automatically urging said stopper from the second position to the first position upon release of a force to the shaft means, and said stopper permitting fluid introduced into the sink to drain from said at least one aperture through the drainage flow passage established in said housing means in said first position and said stopper blocking drainage of fluid through said drainage flow passage in said second position and permitting fluid to drain from said aperture through said overflow passage when the level of fluid collected in the sink reaches a predetermined level.

11. The accessory as described in claim 10 wherein said housing means includes an upright hollow tube.

12. The accessory as described in claim 11 wherein said drainage port means includes a plurality of ports provided in the bottom portion of said tube.

13. The accessory as described in claim 12 wherein said housing means further includes an upper cover closing the upper end of said tube.

14. The accessory as described in claim 13 wherein said overflow port means includes a plurality of ports provided through said upper cover.

15. The accessory as described in claim 10 wherein said tubular member is rigidly coupled to the top of said stopper for movement therewith.

16. The accessory as described in claim 15 wherein said stopper includes at least one internal overflow drain passage in communication with said overflow passage of said tubular member.

17. The accessory as described in claim 10 wherein said resilient means includes a spring extending between the bottom member and the bottom of the stopper.

18. The accessory as described in claim 10 wherein said shaft means includes an elongated shaft operatively coupled to the stopper and extending upward to an upper end disposed above said housing means.

19. The accessory as described in claim 18 wherein said shaft means further includes a force-applying knob connected to said upper end of the shaft.

20. The accessory as described in claim 19 wherein said knob possesses a curved upper surface adapted to maintain continuous positive contact with a pivotal cover of the sink during closing and opening.

21. A parts washer comprising a sink adapted to receive parts to be washed by a fluid continuously introduced therein, said sink having a drain opening to drain fluid therefrom, a housing means having a vertically extending body positioned in said sink with a lower end coupled to said drain opening, said housing means further having a drainage port means positioned at a lower portion thereof and overflow port means positioned at an upper portion thereof, a stopper mounted within said housing means for movement between a first position above said drainage port means to a second position beneath said drainage port means, said stopper including means in contact with said housing means to continuously guide said stopper during said movement, said housing means creating a drainage flow passage between said drainage ports and the drain opening and an overflow passage between said overflow ports and the drain opening, shaft means operatively coupled to said stopper and extending above said housing for moving said stopper from said first position to said second position upon application of a force thereto, resilient means operatively coupled to said shaft means and arranged between said stopper and said housing means for automatically urging said stopper from the second position to the first position upon release of a force to the shaft means, and said stopper permitting fluid introduced into the sink to drain therefrom through the drainage flow passage in said first position and said stopper blocking drainage of fluid through said drainage flow passage in said second position and permitting fluid to drain through said overflow passage when the level of fluid collected in the sink reaches a predetermined level.

22. The parts washer of claim 21 wherein said sink includes a pivotally mounted cover movable from an open position to a closed position covering said sink.

23. The parts washer of claim 22 wherein said shaft means is displaceable in a vertical direction to move said stopper from said first position to said second position.

24. The parts washer of claim 23 wherein said shaft means includes an actuator means adapted to contact said cover during at least a portion of its movement from said open position to said closed position to effect movement of said stopper from said first position to said second position.

25. The parts washer of claim 23 wherein said actuator means includes a knob.

26. The parts washer of claim 23 wherein said upper portion of said knob includes a curved configuration to maintain positive contact between the cover and said knob.

* * * * *

UNITED STATES PATENT OFFICE

CERTIFICATE OF CORRECTION

Patent No. 4,261,378 Dated April 14, 1981

Inventor(s) Karl G. Otzen

It is certified that error appears in the above-identified patent and that said Letters Patent are hereby corrected as shown below:

Column 1, line 14, "selection" should be -- selective --;

Column 3, line 59, before the word "solvent", the words -- of fluid -- should be inserted;

Column 4, line 24, the word "thread" should be --threaded --;

Column 5, line 36, after the word "and", the word -- a -- should be inserted.

Signed and Sealed this

Seventh Day of July 1981

[SEAL]

Attest:

RENE D. TEGTMEYER

Attesting Officer

Acting Commissioner of Patents and Trademarks